US006314161B1

(12) United States Patent
Anno

(10) Patent No.: US 6,314,161 B1
(45) Date of Patent: Nov. 6, 2001

(54) ROTARY ANODE TYPE X-RAY TUBE AND X-RAY TUBE APPARATUS PROVIDED WITH X-RAY TUBE

(75) Inventor: Hidero Anno, Otawara (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/635,397

(22) Filed: Aug. 10, 2000

(30) Foreign Application Priority Data

| | | |
|---|---|---|
| Aug. 10, 1999 | (JP) | 11-226275 |
| Dec. 17, 1999 | (JP) | 11-358960 |
| Jun. 23, 2000 | (JP) | 12-189903 |

(51) Int. Cl.[7] ..... H01J 35/12
(52) U.S. Cl. ..... 378/125; 378/144
(58) Field of Search ..... 378/125, 126, 378/144

(56) References Cited

U.S. PATENT DOCUMENTS

| | | | | |
|---|---|---|---|---|
| 4,081,707 | | 3/1978 | Hartl et al. . | |
| 4,357,555 | | 11/1982 | Gerkema et al. . | |
| 4,811,375 | | 3/1989 | Klostermann . | |
| 4,949,369 | * | 8/1990 | Bittl | 378/130 |
| 5,701,336 | * | 12/1997 | Jacob | 378/132 |
| 5,838,763 | | 11/1998 | Hiller et al. . | |
| 6,091,799 | * | 7/2000 | Schimidt | 378/137 |

FOREIGN PATENT DOCUMENTS

| | | |
|---|---|---|
| 724 283 | 7/1996 | (EP) . |
| 895 273 | 2/1999 | (EP) . |
| 3-182037 | 8/1991 | (JP) . |
| 3-77617 | 12/1991 | (JP) . |
| 5-144396 | 6/1993 | (JP) . |
| 8-241686 | 9/1996 | (JP) . |

* cited by examiner

*Primary Examiner*—Robert H. Kim
*Assistant Examiner*—Irakli Kiknadze
(74) *Attorney, Agent, or Firm*—Pillsbury Winthrop LLP

(57) ABSTRACT

An x-ray tube apparatus comprises a cathode structure emitting an electron beam, a anode target arranged to face the cathode structure, a rotary structure fixed to the anode target, a stationary shaft having bearings arranged between the stationary shaft and the rotary structure for rotatably supporting the rotary structure, and a vacuum envelope provided with an x-ray transmitting window for taking the X-ray generated from the anode target to the outside. The end portion of the stationary shaft on the side of the cathode structure and the other end portion on the side of the anode terminal are fixed to parts of the vacuum envelope. Particularly, the joining portion on the side of the cathode structure is deviant from the axis of rotation of the anode target and the rotary structure and positioned on the side opposite to the cathode structure and the X-ray transmitting window with respect to the axis of rotation. In the x-ray tube apparatus of the particular construction, the dielectric strength on the side of the cathode structure can be sufficiently maintained, and the apparatus can be made compact.

8 Claims, 10 Drawing Sheets

ROTARY ANODE TYPE X-RAY TUBE AND X-RAY TUBE APPARATUS PROVIDED WITH X-RAY TUBE

CROSS-REFERENCE TO RELATED APPLICATIONS

This application is based upon and claims the benefit of priority from the prior Japanese Patent Applications No. 11-226275, filed Aug. 10, 1999; No. 11-358960, filed Dec. 17, 1999; and No. 2000-189903, filed Jun. 23, 2000, the entire contents of which are incorporated herein by reference.

BACKGROUND OF THE INVENTION

The present invention relates to a rotary anode type X-ray tube and an X-ray tube apparatus provided with a rotary anode type X-ray tube.

A rotary anode type X-ray tube comprises a disk-like anode target, a cathode structure for irradiating the target with an electron beam, a rotary structure for rotatably supporting the anode target, and a stationary shaft or structure for supporting the rotary structure with a bearing arranged therebetween, which are arranged within a vacuum envelope. A stator coil for generating a rotating magnetic field for rotating the rotator is arranged outside the vacuum envelope.

In general, the rotary anode type X-ray tube and the stator coil of the construction described above are housed in a vessel for housing an X-ray tube constructed such that an insulating medium is loaded and circulated therein. The structure of the particular construction is mounted as an X-ray tube apparatus in an x-ray tube system such as a CT scanner so as to be used. In the x-ray tube apparatus, the insulating medium that is allowed to flow through the clearance or gap between the rotary anode type X-ray tube and the housing vessel serves to ensure an electrical insulation among the members providing a large potential difference during the operation and also serves to cool the rotary anode type X-ray tube.

In the apparatus of the construction described above, the stator coil arranged outside the vacuum envelope generates a rotating magnetic field, and the anode target is rotated by the rotating magnetic field. Under this state, electron beams generated from the cathode are allowed to strike against the anode target, with the result that an X-ray is generated from the anode target.

In the rotary anode type X-ray tube, a bearing is arranged between the rotary structure and the stationary shaft. The bearing includes a roller bearing such as a ball bearing and a dynamic pressure slide bearing in which a spiral groove is formed on at least one of bearing surfaces faced to each other with a gap, and the bearing gap and the spiral groove is filled with a liquid metal lubricant such as gallium (Ga) or a gallium-indium-tin (Ga—In—Sn) alloy.

A rotary anode type X-ray tube using a dynamic pressure slide bearing is disclosed in, for example, Japanese Patent Publication (Kokoku) No. 3-77617, Japanese Patent Disclosure (Kokai) No. 3-182037, Japanese Patent Disclosure No. 5-144396, Japanese Patent Disclosure No. 8-241686 and U.S. Pat. No. 5,838,763.

In the dynamic slide bearing used in the rotary anode type X-ray tube, the small clearance or gap, e.g., a clearance of about 20 $\mu$m, is retained between the bearing surfaces; and a liquid metal lubricant is loaded in the spiral groove and the clearance of the bearing. In this case, unless the liquid metal lubricant permeates uniformly over the entire region of the clearance of the bearing, it is impossible to obtain a sufficient dynamic pressure, resulting in failure to maintain a stable bearing operation. In the extreme case, the bearing surfaces bite each other to make the rotation impossible or to bring about breakage.

The dynamic slide bearing that was put to practical use in the past is of a cantilever structure. Therefore, the stress applied to an edge portion of the bearing stationary shaft fixed to the x-ray tube housing vessel is increased with increase in the weight of the anode target, giving rise to a problem in the mechanical stability. Also, if an unbalance in pressure is generated by the centrifugal force received by the liquid metal lubricant in the bearing portion, the liquid metal lubricant tends to leak from the bearing, with the result that the disk-like anode target is considered to fail to rotate smoothly.

In order to overcome the problem described above, a dynamic slide bearing of a support structure for supporting the stationary shaft at both side is disclosed in, for example, U.S. Pat. No. 5,838,763. In the apparatus disclosed in this prior art, both sides of the stationary shaft of the bearing extend along the axis of rotation so as to be coupled with the vacuum envelope. Also, the stationary shaft is made hollow to permit a cooling medium to flow through the central bore.

In the rotary anode type X-ray tube of the construction described above, it is necessary arrange the cathode structure sufficiently apart from the anode target or the extending portion of the bearing stationary shaft because a large potential difference is provided therebetween, giving rise to the inconvenience that it is unavoidable to enlarge undesirably the length in the axial direction and the diameter in the radial direction of the X-ray tube.

BRIEF SUMMARY OF THE INVENTION

An object of the present invention is to provide a compact rotary anode type X-ray tube which can improve the dielectric strength or withstanding voltage on the side of the cathode structure and an x-ray tube apparatus housing the particular X-ray tube.

According to a first aspect of the present invention, there is provided a rotary anode type X-ray tube comprising a cathode structure for emitting an electron beam, a anode target arranged to face the cathode structure, a rotary structure fixed to the anode target, a stationary shaft for rotatably supporting the rotary structure with a bearing arranged between the rotary structure and the stationary shaft, and a vacuum envelope provided with an X-ray transmitting window for taking an X-ray generated from the anode target to the outside, wherein one end portion of the stationary shaft on the side of the cathode structure and the other end portion of the anode terminal on the opposite side are fixed to parts of the vacuum envelope, and the fixed portion on the side of the cathode structure is deviant from the axis of rotation of the anode target and the rotary structure and positioned on the side opposite to the cathode structure and the X-ray transmitting window with respect to the axis of rotation noted above.

Also, according to a second aspect of the present invention, there is provided an x-ray tube apparatus, comprising a vessel for housing a rotary anode type X-ray tube, the stationary shaft of the X-ray tube being hollow to permit circulation of an insulating cooling medium through the bore of the stationary shaft, characterized in that the edge portion of the stationary shaft of the X-ray tube is connected to an insulating cooling medium circulating hole made in the wall of the housing vessel directly or with an insulating pipe interposed therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
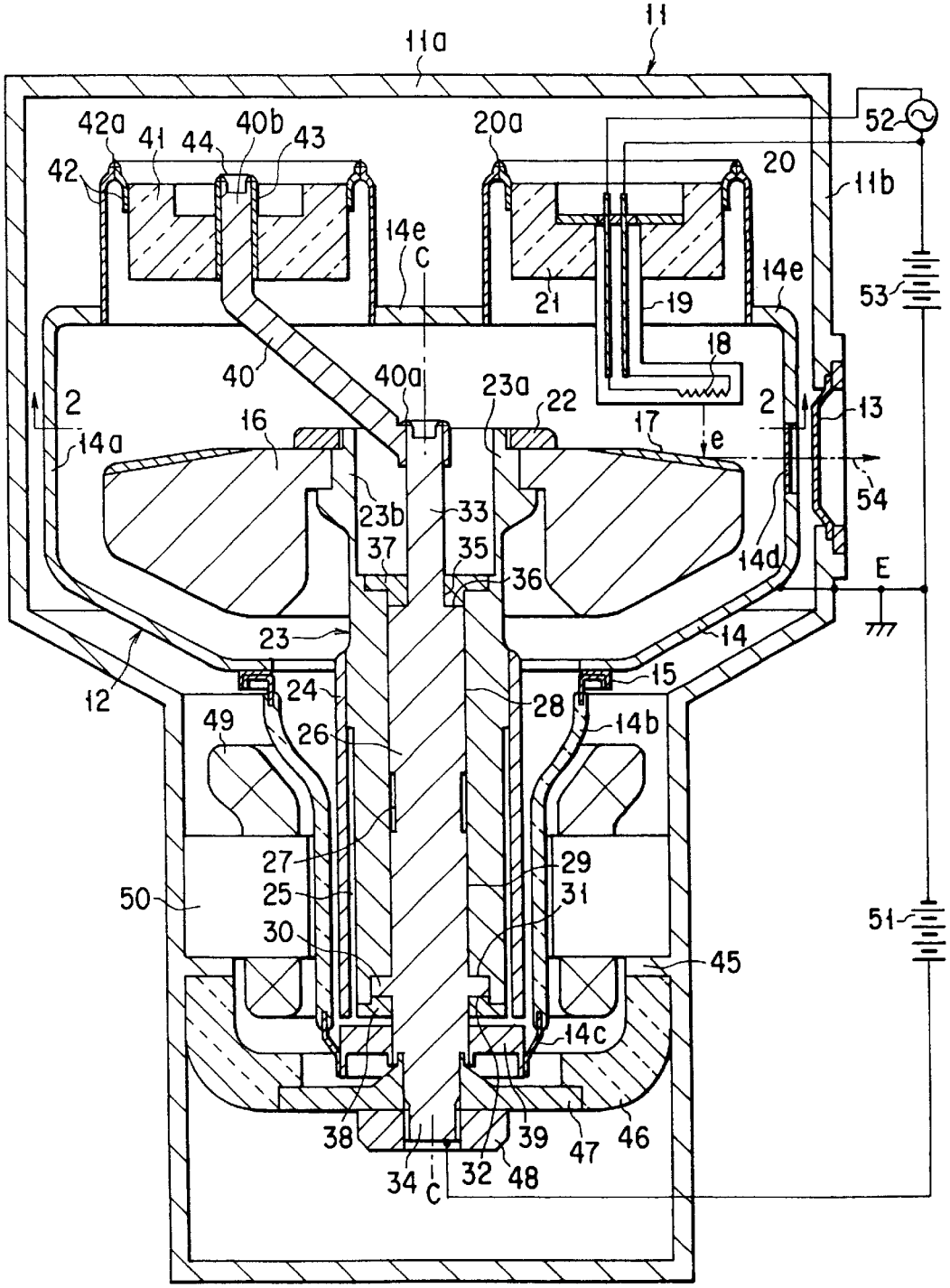
FIG. 1 is a vertical cross sectional view schematically showing an x-ray tube apparatus according to one embodiment of the present invention.
Figure 2:
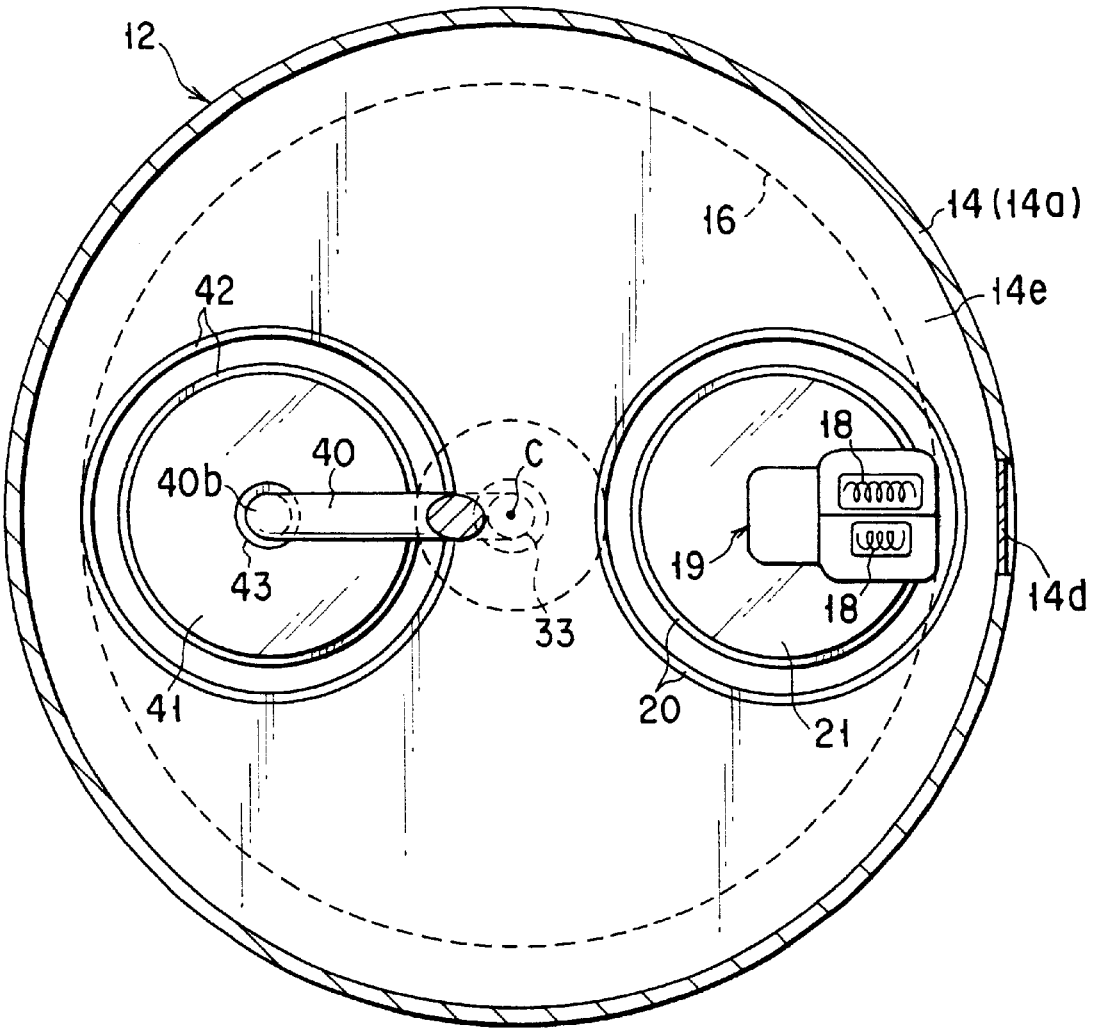
FIG. 2 is a lateral cross sectional view along the line 2—2 shown in FIG. 1.

An x-ray tube apparatus according to a first embodiment of the present invention will now be described with reference to FIGS. 1 to 3D. A reference numeral 11 in FIG. 1 represents a vessel for housing an X-ray tube. A rotary anode type X-ray tube 12 is arranged within the housing vessel 11. The main portion of the housing vessel 11 is formed of an aluminum casting, and the inner surface of the housing vessel 11 is partly lined with a lead plate (not shown) so as to prevent an X-ray leakage.

The housing vessel 11 includes an end wall 11*a* that is formed flat. A hole (not shown) for introducing or discharging an insulating cooling medium such as an insulating oil is formed through the end wall 11*a*. The housing vessel 11 also includes a side wall portion 11*b*. An X-ray output window 13 for outputting an X-ray is formed in the side wall portion 11*b*. Also, the clearance or space between the housing vessel 11 and the rotary anode type X-ray tube 12 is filled with an insulating medium such as an insulating oil. The insulating medium is circulated by an external heat exchanger, a pump, etc. (not shown).

The rotary anode type X-ray tube 12 comprises a vacuum envelope 14 including, for example, a large diameter portion 14*a* made of a metal, a small diameter portion 14*b* made of glass, and a seal ring 14*c* made of a metal and serving to close the open edge portion of the small diameter portion 14*b*. The large diameter portion 14*a* and the small diameter portion 14*b* are joined to each other via a connecting member 15 made of a metal. An X-ray transmitting window 14*d* that transmits an X-ray is formed in that portion of the large diameter portion 14*a* which corresponds to the X-ray output window 13 of the housing vessel 11.

A disc-like anode target 16 is arranged inside the large diameter portion 14*a* of the vacuum envelope. A X-ray emissive layer 17 having a predetermined thickness is provided on the anode target 16 and is arranged to form a ring on the side of the upper surface of the disc-like anode target 16. Also, a cathode structure 19 provided with an electron beam emitting filament 18 is arranged to face the anode target portion 17. The cathode structure 19 is held by a hermetically bonded annular insulating ceramic member 21 in a region close to the X-ray transmitting window 14*d* of the side wall 14*e* of the vacuum envelope via a pair of sealing metal cylinders 20 having aligned portions 20*a* at the tips hermetically welded.

The disc-like anode target 16 is fixed to an upper edge portion 23*a* in the drawing of a cylindrical rotary structure 23 by a nut 22. A rotary structure cylinder 24 made of copper is partly fixed to the outer circumferential surface in a lower portion of the rotary structure 23, and a heat insulating space 25 is formed in another large portion.

Figure 3A:
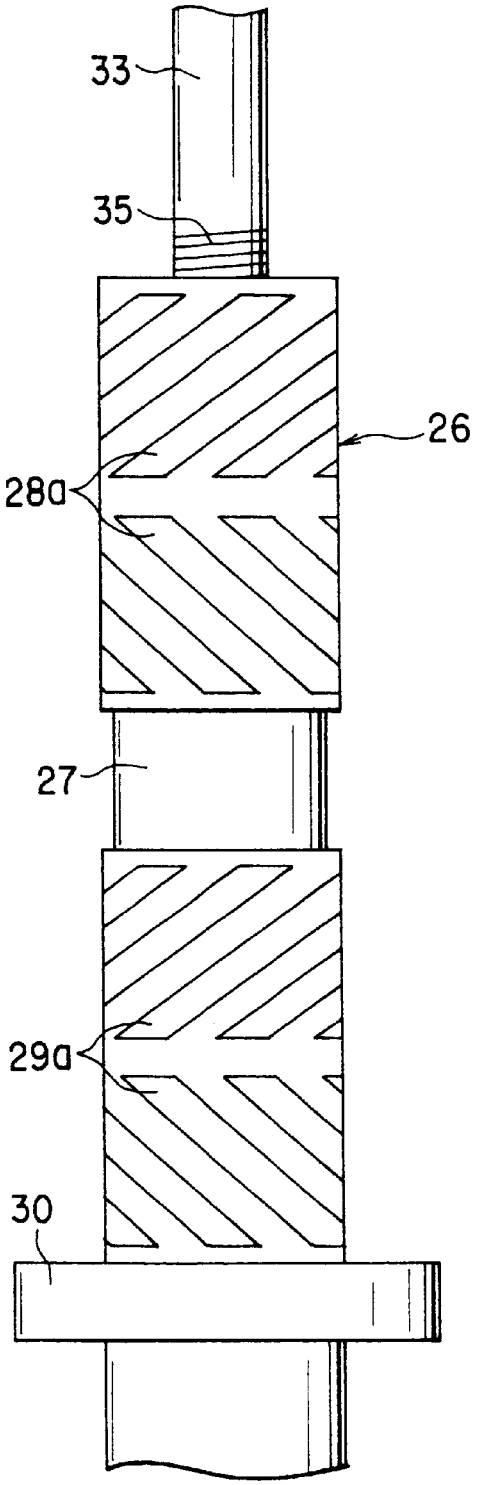
FIG. 3A is a side view showing a gist portion of the stationary shaft shown in FIG. 1.
Figure 3B:
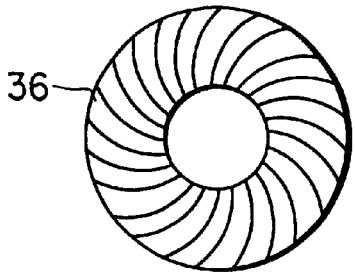
FIGS. 3B, 3C and 3D are plane views showing thrust bearing surfaces shown in FIG. 3A.
Figure 3C:
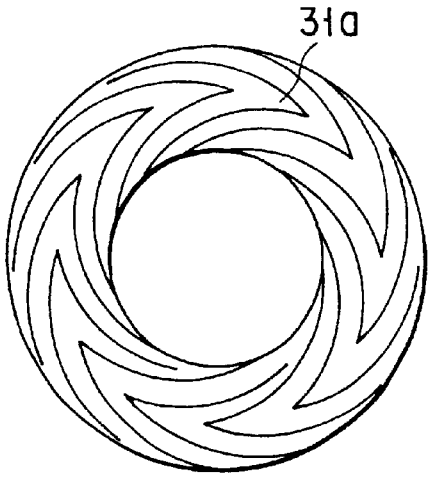
Figure 3D:
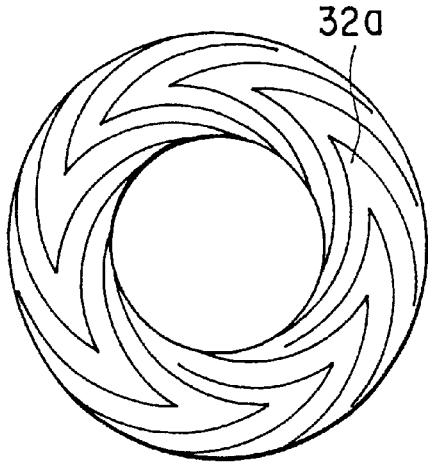

A columnar stationary shaft or shaft 26 is inserted into the inner bore of the rotary structure 23. These rotary structure 23 and stationary shaft 26 are main constituent members of a dynamic slide bearing. Therefore, as shown in detail in FIG. 3A, spiral grooves 28*a*, 29*a* each having a pattern like a herringbone pattern, which are for two pairs of dynamic slide bearings 28, 29 in a radial direction, are formed on both the upper and lower sides of an intermediate recess 27. Also, a large diameter portion is formed in a lower portion in the drawing. Spiral grooves 31*a*, 32*a* each having a circular herringbone pattern are formed for a pair of dynamic slide bearings 31, 32 in the thrusting direction on the upper and lower surfaces of the large diameter portion 30 as shown in FIGS. 3C and 3D.

Further, an extending portion 33 having a small diameter is arranged in an upper portion of the stationary shaft, and an extending portion 34 having a large diameter is formed in a lower portion of the stationary shaft. A spiral groove 35 for a pump for preventing the liquid metal lubricant from leaking upward in the drawing is formed in a base portion of the extending portion 33 in the upper portion of the stationary shaft. Also, a spiral groove 36 for a pump for preventing a lubricant leakage is formed in the shoulder portion as shown in FIG. 3B.

An inner space 23*b* in the upper portion 23*a* in the drawing of the rotary structure 23 is formed to have a large inner diameter. A first thrust ring 37 is fixed to the rotary structure by a plurality of screws (not shown) such that the thrust ring 37 has an inner surface so faced to spiral grooves 35, 36 with a small gap as to seal the small gap in the vicinity of the shoulder portion of the stationary shaft 26 providing the bottom portion of the inner space 23*b* so as to close the open portion.

A second thrust ring 38 is fixed to the rotary structure by a plurality of screws (not shown) on the lower side of the large diameter portion 30 in a lower portion of the stationary shaft such that the second thrust ring 38 is in contact with the spiral groove 32*a* and closes the open region below the rotary structure. A sealing metal disc 39 is hermetically welded to the extending portion 34 having a large diameter in a lower portion of the stationary shaft, and the projecting portion on the outer circumferential surface of the disc 39 is hermetically welded to the seal ring 14*c*. It should be noted that a metal lubricant, which is in a liquid form at least during the operation such as a Ga alloy, is supplied to the bearing clearance including each bearing region and the central recess 27.

The extending portion 33 having a small diameter in an upper portion of the stationary shaft extends along the axis C of rotation to reach an upper surface portion of the anode target 16, i.e., to reach a region close to the open portion in the upper end portion 23*a* having a large diameter of the rotary structure. One end portion 40*a* of an arm 40 for supporting the stationary shaft, said arm 40 consisting of an obliquely extending metal rod, is integrally bonded by welding to the tip portion of the extending portion 33 having a small diameter. The other end portion 40*b* of the arm 40 for supporting the stationary shaft is mechanically fixed to the central portion of a ring-like insulating ceramic member 41 formed in a part of the end wall 14*e* of the vacuum envelope, i.e., formed in a position opposite to the cathode structure 19 with respect to the axis C of rotation.

To be more specific, the ring-like insulating ceramic member 41 is hermetically bonded to the end wall 14*e* of the vacuum envelope via a pair of sealing metal cylinders 42 having aligned portions 42*a* at the tips hermetically welded. Also, a metal pipe 43 is hermetically bonded to a central through-hole of the insulating ceramic member 41. The tip portion of the arm 40 for supporting the stationary shaft is closely inserted into the metal pipe 43, and the tip of the arm 40 is fixed to a hermetically welded portion 44 in a vacuum-tight fashion.

As described above, the cathode structure side of the stationary shaft of the bearing obliquely extends on the side opposite to the cathode structure 19 and the X-ray transmitting window 14*d* with respect to the axis C of rotation so as to be mechanically coupled with a part of the vacuum envelope in an electrically insulated fashion. In this embodiment, the hermetically welded portion 44 at the tip of the stationary shaft supporting arm 40 constitutes the coupling portion.

The rotary anode type X-ray tube 12 is housed in and fixed to the X-ray tube housing vessel 11 such that the X-ray transmitting window 14*d* and the X-ray output window 13 coincide with each other. As a result, a bottle-shaped holding frame 46 made of an insulating material is fixed to a flange 45 of the housing vessel 11, and a metal ring 47 is fixed to the bottom portion of the holding frame 46. Also, the lower end portion 34 of the stationary shaft extending outside the vacuum envelope of the X-ray tube is closely inserted into the central through-hole of the metal ring 47, and a nut 48 is engaged with the externally threaded portion of the lower end portion 34. As a result, the stationary shaft is fastened and fixed. Incidentally, an iron core 50 of a stator coil 49 is fixed to the flange 45 of the housing vessel 11. Also, the envelope of the X-ray tube at the side of the cathode structure is mechanically held in the housing vessel by an insulator (not shown). Further, the metal ring 47 also acts as an anode terminal.

Hoses (not shown) for introducing and discharging an insulating oil, which are connected to the housing vessel, are connected to a heat exchanger (not shown) and a circulating pump (not shown) arranged outside the housing vessel. In, for example, a CT scanner having the above-described x-ray tube apparatus to be mounted therein, the metal portion of the vacuum envelope of the x-ray tube and the housing vessel are connected to the ground E. First and second high voltage power sources 51 and 53 are connected to the apparatus. Specifically, the positive electrode of the first high voltage power source 51 is electrically connected to the metal ring 47 acting as an anode terminal. A power source for heating the filament 18 is connected to the cathode structure 19. Further, the negative electrode of the second high voltage power source 53 is electrically connected to the filament 18. These first and second high voltage power sources 51 and 53 are power sources of a neutral ground system each having a power source voltage of, for example, 70 kV. As a result, a high voltage of 140 kV is applied between the filament 18 of the cathode structure and the anode target 16 for operation of the apparatus to permit an x-ray 54 to be emitted to the outside through the output window 13. During operation of the x-ray tube apparatus, the lower end portion 26 of the stationary shaft 26 of the X-ray tube is cooled by the insulating oil. The tip portion 40*b* of the supporting arm is also brought into contact with the insulating oil so as to be cooled. Incidentally, it is possible to cover the tip portion 40*b* of the supporting arm exposed to the outside of the vacuum envelope with an insulating material so as to increase the dielectric strength between the tip portion 40*b* and the housing vessel.

According to the embodiment of the present invention described above, the extending end portion on the side of the cathode structure of the stationary shaft constituting a member of the dynamic slide bearing of the X-ray tube is bent and allowed to extend in a direction deviant from the axis C of rotation. The end portion 40*b* of the extending portion is mechanically coupled with a part of the vacuum envelope at a position deviant from the axis C of rotation on the side opposite to the cathode structure 19 and the x-ray transmitting window 14*d*. As a result, even if a large potential difference is generated during the operation between the cathode structure and the stationary shaft of the bearing, discharge between the two can be prevented because the cathode structure and the stationary shaft are positioned sufficiently apart from each other.

It follows that discharge is unlikely to take place in spite of the compact construction that the length in, particularly, the axial direction and the diameter in the radial direction of the rotary anode type X-ray tube and the x-ray tube apparatus housing the particular X-ray tube are not unduly increased. It should be noted that the stationary shaft of the bearing supporting the anode target is coupled to and held by the vacuum envelope on both sides. Therefore, the anode target having a relatively large mass can be stably supported so as to maintain the operation of a high reliability.

Figure 4:
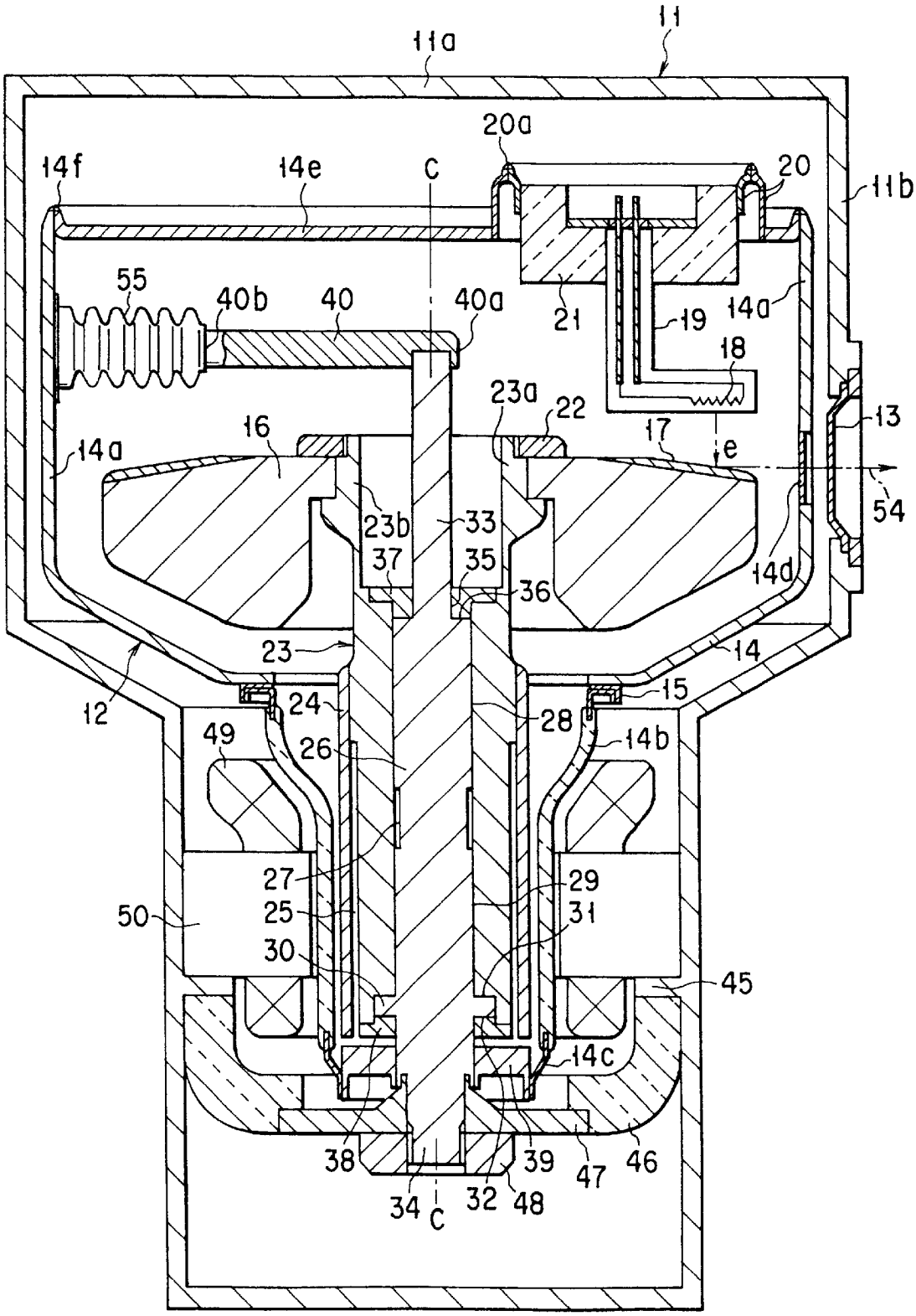
FIG. 4 is a vertical cross sectional view schematically showing an x-ray tube apparatus according to another embodiment of the present invention.

The embodiment shown in FIG. 4 will now be described. Those portions of the apparatus which are equal to those of the embodiment shown in FIGS. 1 to 3D are denoted by the same reference numerals so as to omit the overlapping description. In the embodiment shown in FIG. 4, the one end portion 40*a* of the stationary shaft supporting arm 40 is mechanically joined to the extending portion 33 having a small diameter in the upper portion of the stationary shaft 26, and the stationary shaft supporting arm 40 extends in a direction perpendicular to the axis C of rotation on the side opposite to the side of the cathode structure 19 and the X-ray transmitting window 14*d* with respect to the axis C of rotation. Also, the end portion 40*b* of the arm 40 is fixed to the tip of a ceramic insulator 55 that is fixed by brazing to the inner surface of the side wall 14*a* in a large diameter portion of the vacuum envelope made of a metal.

In this embodiment, the extending end portion on the side of the cathode structure of the stationary shaft constituting a member of the bearing is fixed to a position deviant from the axis C of rotation, i.e., to the side wall of the vacuum envelope via the arm 40 and insulator 55 positioned on the side opposite to the cathode structure 19 and the X-ray transmitting window 14*d* with respect to the axis C of rotation. The particular construction makes it possible to ensure a sufficiently high dielectric strength between the cathode structure and the member connected to the ground and to ensure a sufficient compactness of the apparatus.

Figure 5:
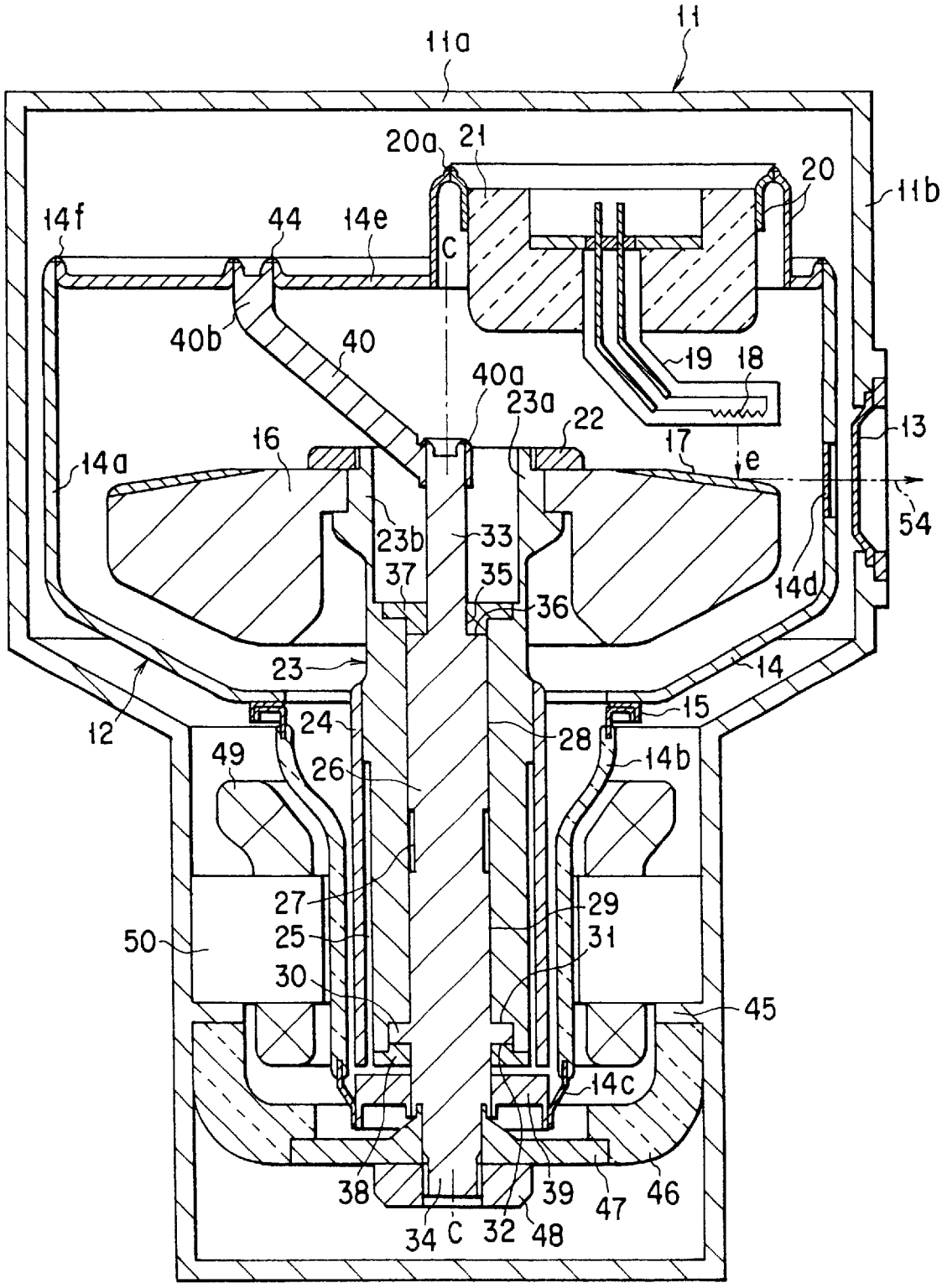
FIG. 5 is a vertical cross sectional view schematically showing an x-ray tube apparatus according to another embodiment of the present invention.

FIG. 5 shows another embodiment of the present invention. This embodiment is directed to a rotary anode type X-ray tube adapted to the case where the X-ray tube is operated with both the anode target and the metal portion of the vacuum enveloped connected to the ground, and to an x-ray tube apparatus housing the particular X-ray tube. Incidentally, those portions of the apparatus which are equal to those of the embodiments described previously are denoted by the same reference numerals so as to avoid an overlapping description.

Specifically, the stationary shaft supporting arm 40 fixed to the extending portion 33 having a small diameter in the upper portion of the stationary shaft 26 extends obliquely upward on the side opposite to the cathode structure 19 and the x-ray transmitting window 14*d* with respect to the axis C of rotation, and the end portion 40*b* of the arm 40 is fixed directly to the end wall 14*e* made of a metal of the vacuum envelope. Incidentally, a reference numeral 14*f* represents a hermetically welded portion between the side wall 14*a* having a large diameter, which is made of a metal, of the vacuum envelope and the end wall 14*e*.

In the embodiment shown in FIG. 5, the extending end portion on the side of the cathode structure of the stationary shaft constituting a member of the bearing is fixed directly to the end wall of the vacuum envelope at a position deviant from the axis C of rotation, i.e., at a position on the opposite side of the cathode structure 19 and the X-ray transmitting window 14*d* with respect to the axis C of rotation. The particular construction makes it possible to manufacture the apparatus relatively easily. In addition, it is possible to ensure a sufficient dielectric strength between the cathode structure and the members connected to the ground and to ensure a sufficient compactness of the apparatus. Incidentally, the rotary anode type X-ray tube and the x-ray tube apparatus shown in FIG. 5 are adapted for operation with the anode target connected to the ground.

Figure 6:
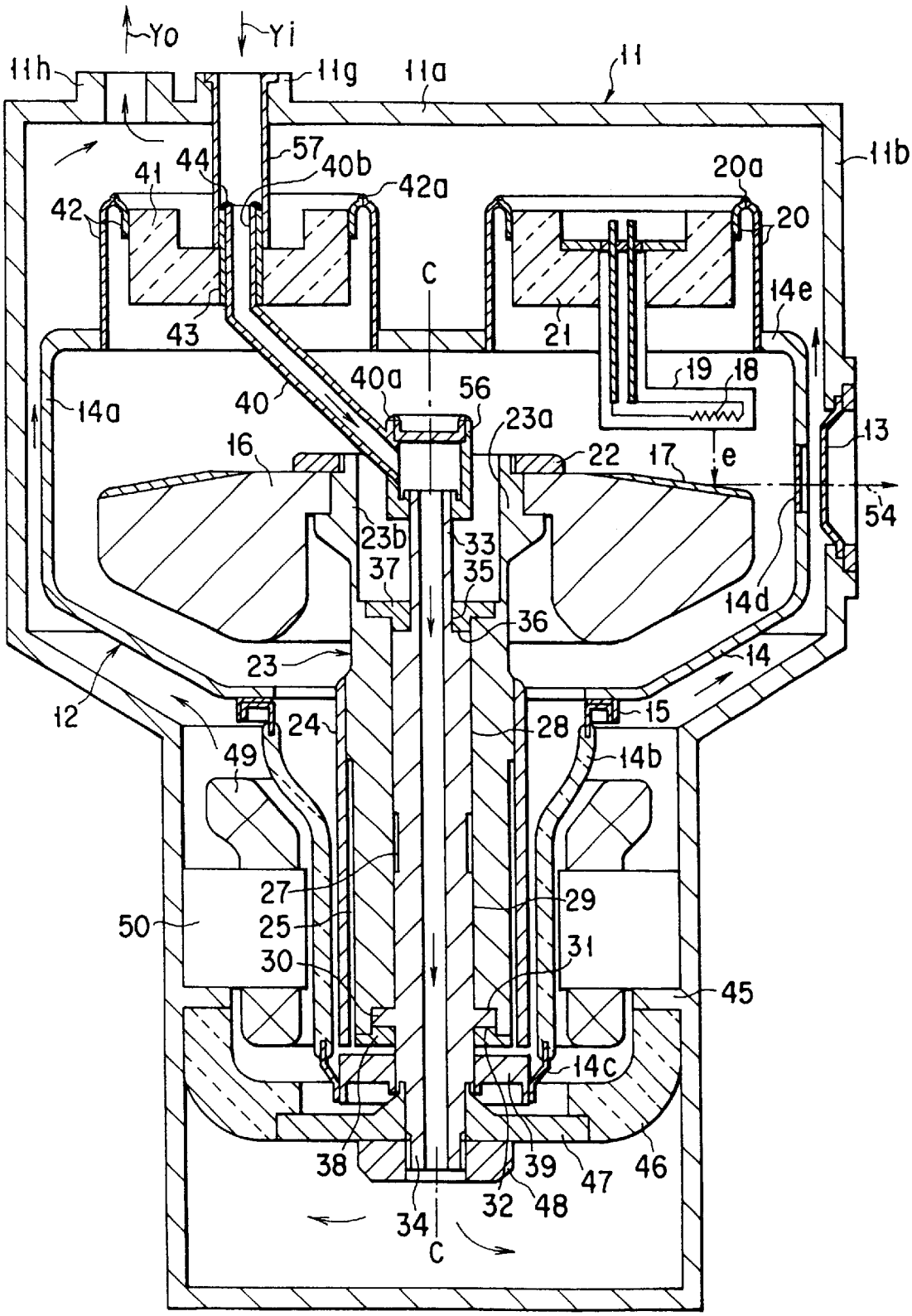
FIG. 6 is a vertical cross sectional view schematically showing an x-ray tube apparatus according to another embodiment of the present invention.

FIG. 6 shows a rotary anode type X-ray tube and an x-ray tube apparatus including the particular x-ray tube according to another embodiment of the present invention. In this embodiment, the stationary shaft 26 constituting a member of the dynamic slide bearing is made hollow, and a cooling medium such as an insulating oil is circulated through the central bore of the stationary shaft 26. Incidentally, those portions of the apparatus which are equal to those of the other embodiments described previously are denoted by the same reference numerals so as to avoid an overlapping description.

To be more specific, a short cylinder 56 for relay is hermetically bonded to the hollow extending portion 33 having a small diameter in the upper portion of the stationary shaft 26. The one end portion 40*a* of the stationary shaft supporting arm 40 is connected to the short cylinder 56, and the arm 40 extends obliquely upward on the side opposite to the cathode structure 19 and the X-ray transmitting window 14*d* with respect to the axis C of rotation such that the other end portion 40*b* of the arm 40 extends through a metal pipe 43 hermetically bonded to a central through-hole of the insulating ceramic member 41 formed in a part of the end wall 14*e* made of a metal of the vacuum envelope. As shown in the drawing, the tip portion of the other end portion 40*b* is connected in a vacuum-tight fashion to the hermetically welded portion 44.

Further, one end portion of a pipe 57 made of an electrically insulating material and serving to guide a cooling medium is tightly engaged with the outer circumferential surface of the bonded portion between the other end portion 40*b* of the hollow stationary shaft supporting arm 40 and the metal pipe 43. The other end portion of the pipe 57 noted above is tightly connected to a cooling medium circulating hole 11*g* formed through the end wall 11*a* of the vessel 11 for housing the X-ray tube. Further, an additional cooling medium circulating hole 11*h* is formed near the cooling medium circulating hole 11*g*.

In operating the rotary anode type X-ray tube and the x-ray tube apparatus of the construction described above, high voltage power sources of the neutral ground system are connected to the apparatus such that a positive high potential is applied to the anode target 16 and a negative high potential is applied to the filament 18 of the cathode structure. At the same time, a cooling medium such as an insulating oil is introduced through the cooling medium circulating hole 11*g* of the housing vessel as denoted by an arrow Yi. The cooling medium thus introduced flows through the bore of the hollow stationary shaft supporting arm 40 and the bore of the hollow stationary shaft 26 so as to be moved into the housing vessel through the lower end of the hollow stationary shaft 26. The cooling medium circulated within the housing vessel is discharged to the outside of the apparatus through the other cooling medium circulating hole 11*h* as denoted by an arrow Yo. Incidentally, the cooling medium such as an insulating oil is circulated by an external heat exchanger (not shown) and a pump (not shown).

According to the embodiment shown in FIG. 6, the dynamic slide bearing portion can be efficiently cooled. Also, it is possible to maintain sufficiently the dielectric strength between the cathode structure and the conductive member, a large potential difference being generated between the cathode structure and conductive member noted above, and to ensure a sufficient compactness of the apparatus.

It should also be noted that a pair of cooling medium circulating holes 11*g*, 11*h* of the X-ray tube housing vessel are formed close to each other, making it possible to arrange hoses connected to the heat exchanger, the circulating pump, etc. close to each other. It follows that the entire apparatus can be miniaturized.

Incidentally, it is also possible to allow the insulating cooling medium to flow in a direction opposite to the direction described above. Specifically, it is possible to introduce the insulating cooling medium through the circulating hole 11*h* of the X-ray tube housing vessel so as to allow the cooling medium to flow through the clearance between the X-ray tube and the housing vessel. In this case, the cooling medium enters the bore of the hollow stationary shaft 26 through the lower end of the stationary shaft 26 and flows upward within the bore of the hollow stationary shaft 26 in the drawing and, then, through the bore of the hollow stationary shaft supporting arm 40 and the insulating pipe 57 so as to be discharged to the outside through the cooling medium circulating hole 11*g*.

Figure 7:
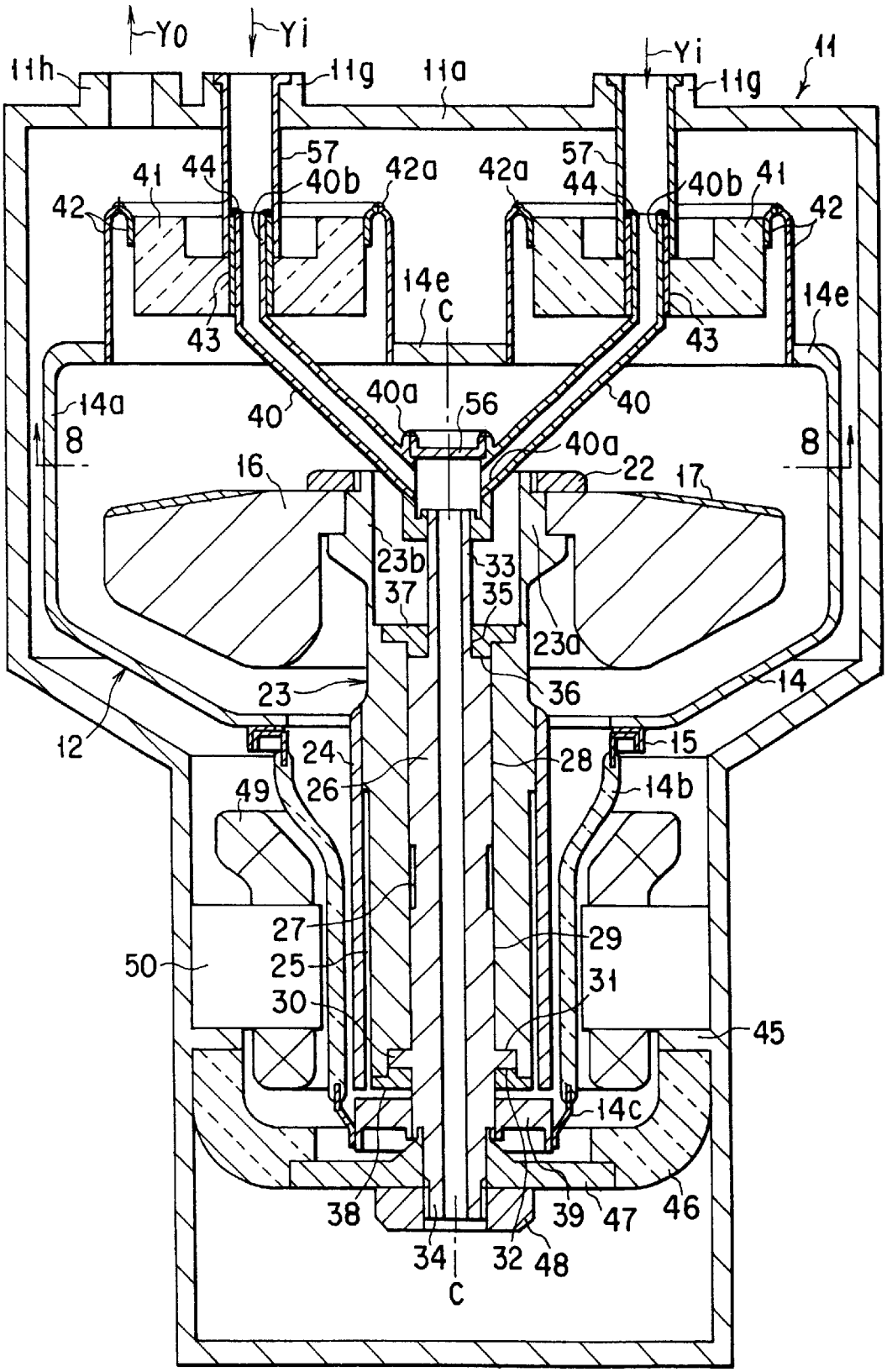
FIG. 7 is a vertical cross sectional view schematically showing an x-ray tube apparatus according to another embodiment of the present invention.
Figure 8:
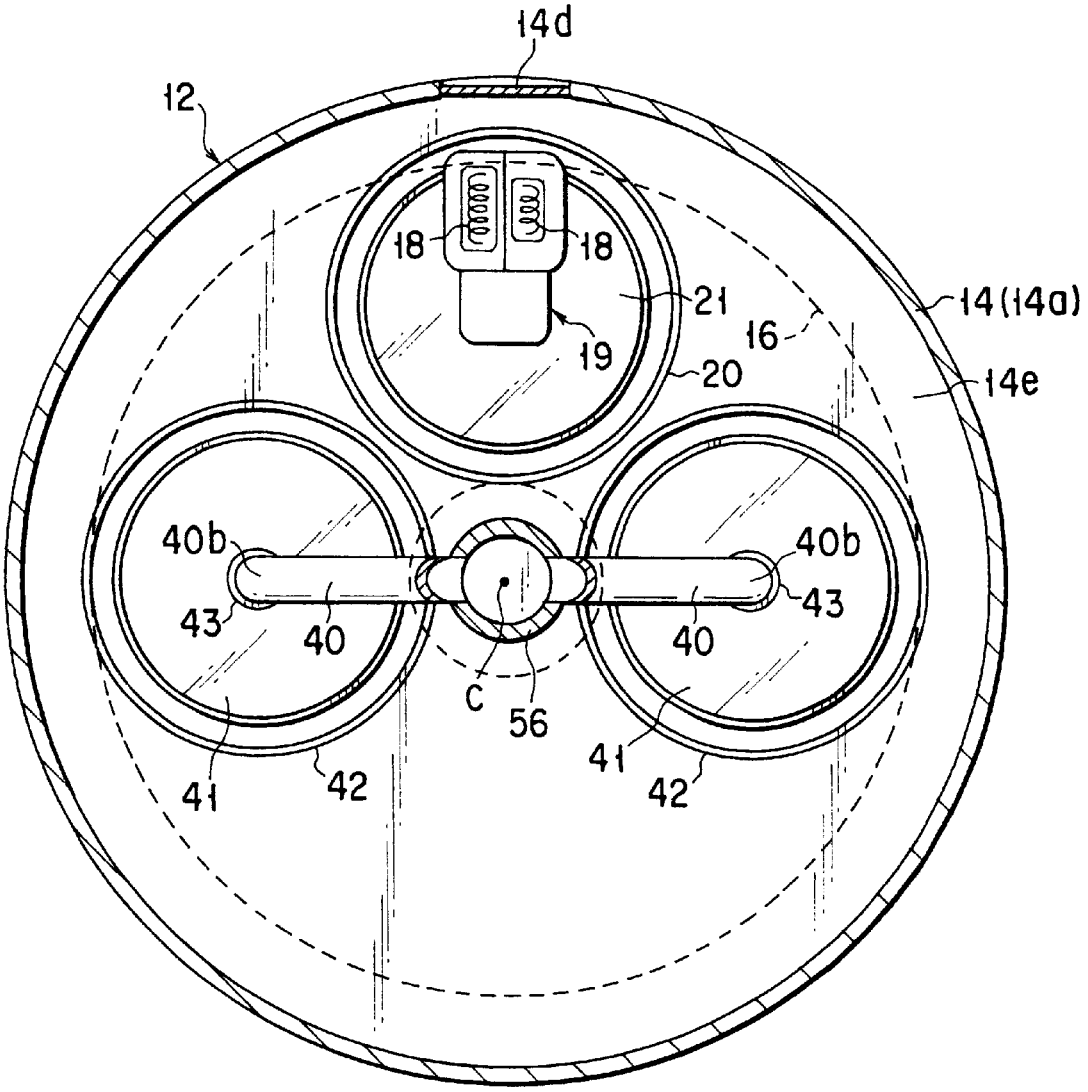
FIG. 8 is a lateral cross sectional view along the line 8—8 shown in FIG. 7.

FIGS. 7 and 8 collectively show another embodiment of the present invention. As shown in the drawings, two hollow arms 40, 40 for supporting the stationary shaft are connected to the short cylinder 56 for relay, which is connected to the hollow extending portion 33 having a small diameter in the upper portion of the hollow stationary shaft. These two hollow arms 40, 40 extend obliquely upward in opposite directions with respect to the axis C of rotation such that the end portions 40*b*, 40*b* are fixed to the central portions of the insulating ceramic members 41, 41 arranged apart from each other in positions deviant from the axis C of rotation. Incidentally, those portions of the apparatus which are equal to those of other embodiments described previously are denoted by the same reference numerals so as to avoid an overlapping description.

Incidentally, in order to prevent the drawing from being made complicated, the relating portions such as the cathode structure and the X-ray transmitting window are not shown in FIG. 7. However, FIG. 8 shows the positional relationship between the modified portion shown in FIG. 7 and the relating members such as the cathode structure and the X-ray transmitting window. To be more specific, as shown in FIG. 8, the cathode structure 19 and the insulating ceramic member 21 supporting the cathode structure 19 are arranged in the vicinity of the X-ray transmitting window 14*d* of the vacuum envelope of the rotary anode type X-ray tube. Also, the hollow arms 40, 40 for supporting the hollow stationary shaft are arranged to extend in opposite directions from the axis C of rotation such that the end portions 40*b*, 40*b* are fixed to the central portions of the insulating ceramic members 41, 41.

In the embodiment shown in FIGS. 7 and 8, a cooling medium such as an insulating oil is introduced from the two cooling medium circulating holes 11*g* as denoted by arrows Yi to flow through the two hollow arms 40, 40 for supporting the hollow stationary shaft. These two streams of the cooling medium are combined at the short cylinder 56 for relay and, then, the combined stream flows downward within the bore of the hollow stationary shaft 26 so as to come out of the bore of the hollow stationary shaft 26 through the lower end of the stationary shaft 26. Further, the cooling medium flows within the apparatus so as to come out of the apparatus through the other cooling medium circulating hole 11*h*, as denoted by the arrow Yo.

In the particular construction described above, since those portions of the stationary shaft on the side of the cathode structure are fixed to the vacuum envelope at two points that are in symmetry with respect to the axis C of rotation, the anode target is supported mechanically more stably. It follows that the apparatus is capable of fully withstanding the use in, for example, a CT scanner in which a high gravitational acceleration is applied. In addition, it is possible to maintain sufficiently the dielectric strength between the cathode structure and the conductive member having a large potential difference provided therebetween and to ensure the compactness of the apparatus.

Figure 9:
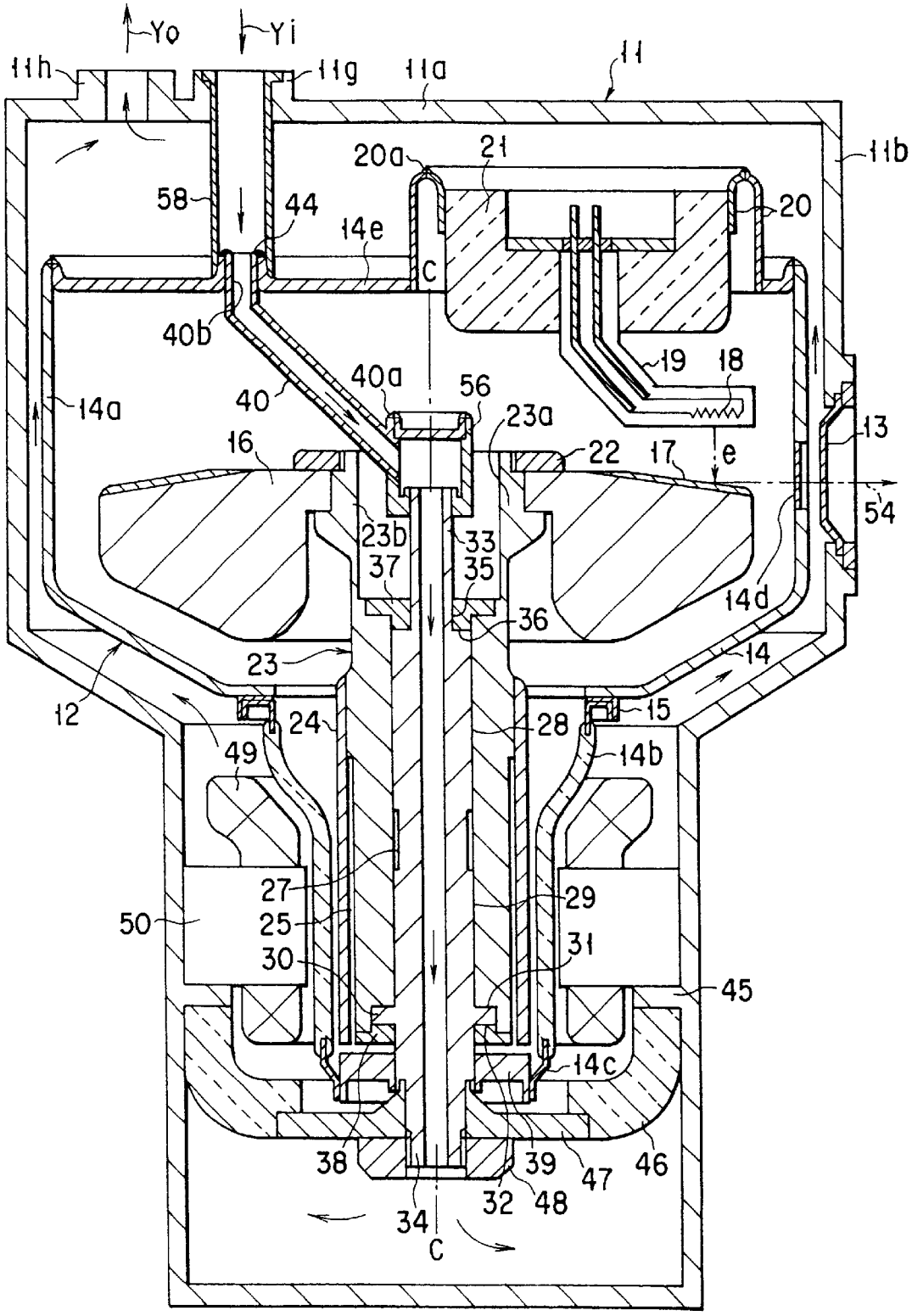
FIG. 9 is a vertical cross sectional view schematically showing an x-ray tube apparatus according to still another embodiment of the present invention.

FIG. 9 shows still another embodiment of the present invention. In this embodiment, the end portion 40*b* of the hollow arm 40 for supporting the hollow stationary shaft on the side of the cathode structure extends through the edge plate 14*e* made of a metal of the vacuum envelope so as to be fixed to the hermetic welding portion 44. The fixed portion is deviant from the axis C of rotation and is on the side opposite to the cathode structure 19 with respect to the axis C of rotation, as in the other embodiments described previously. Also, the cooling medium circulating hole 11*g* made in the edge plate of the housing vessel 11 communicates with the end portion 40*b* of the supporting arm 40*b* via a guide pipe 58 made of a metal. Naturally, the cooling medium is guided from the hole 11*g* to the end portion 40*b* via the guide pipe 58. Also, an electrical short circuiting is achieved between the hole 11*g* and the end portion 40*b*.

The rotary anode type X-ray tube and the x-ray tube apparatus in this embodiment are adapted for operation with the anode target and the housing vessel connected to the ground. Also, it is possible to ensure sufficiently the dielectric strength on the side of the cathode structure and to ensure a sufficient compactness of the apparatus.

Figure 10:
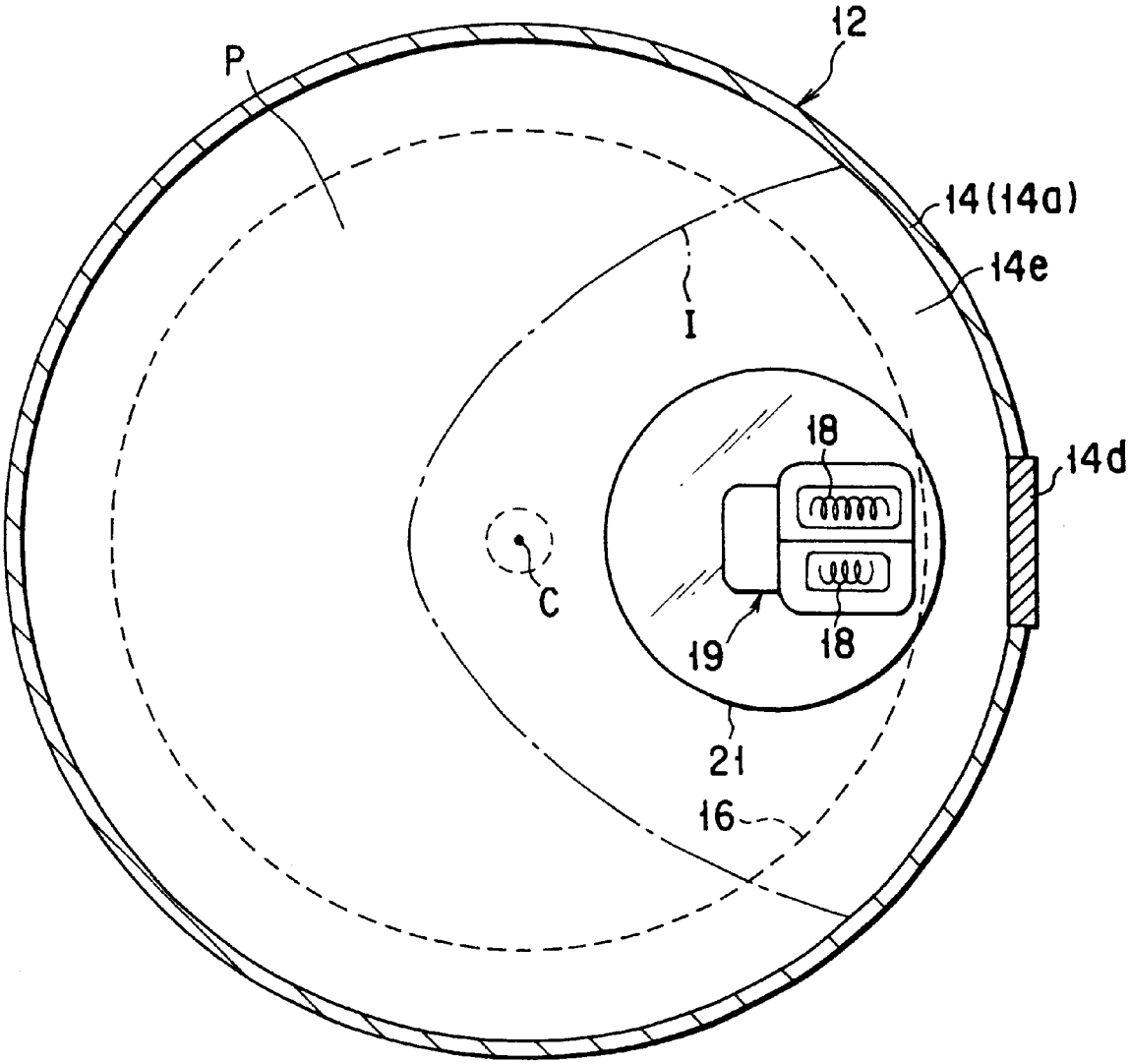
FIG. 10 is a lateral cross sectional view showing the coupling region between the extending portion of the stationary shaft and the vacuum envelope in the x-ray tube apparatus of the present invention.

Incidentally, it is desirable for the extending end portion of the stationary shaft constituting a member of the dynamic slide bearing on the side of the cathode structure to be fixed to the vacuum envelope within, for example, a large region P defined between a one dot chain line and the side wall 14*a* as shown in FIG. 10 in order to prevent the discharge between the members having a large potential difference provided therebetween. To be more specific, it is desirable for the extending end portion of the stationary shaft on the side of the cathode structure to be mechanically fixed in a region deviant from the axis C of rotation and apart from the cathode structure 19 and the X-ray transmitting window 14*d* by a distance large enough to obtain a dielectric strength. Of course, where the extending end portion of the stationary shaft on the side of the cathode structure is bonded in a manner to be electrically insulated from the metal portion of the vacuum envelope, the bonding position should be determined in view of the region occupied by the insulating member for the electrical insulation.

In each of the embodiments described above, the rotary anode type X-ray tube comprises a dynamic slide bearing. However, the present invention is not limited to the embodiments described above. For example, the technical idea of the present invention can also be applied to a rotary anode type X-ray tube comprising a roller bearing such as a ball bearing.

As described above in detail, the present invention provides a compact rotary anode type X-ray tube and an x-ray tube apparatus comprising the particular X-ray tube, which permit stabilizing the operation of the dynamic slide bearing over a long period of time, and which also make it possible to maintain a dielectric strength over a long period of time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode type X-ray tube, comprising:

a cathode structure for emitting an electron beam a rotary anode target, having a rotational axis and faced to said cathode structure, for radiating an X-ray upon impinging of the electron beam;

a rotary structure having the rotational axis and fixed to said rotary anode target;

a stationary shaft for rotatably supporting the rotary structure, which is fitted in said rotary structure and said anode target, is so arranged as to penetrate the anode target and has one end at the side of said cathode structure and other end at the opposite side of said cathode structure;

a bearing, arranged between said rotary structure and stationary shaft, for allowing said rotary structure to rotate around said stationary shaft; and a vacuum envelope for housing said cathode structure, said rotary anode target, said stationary shaft and said rotary structure, which has a X-ray window for transmitting an X-ray, the one and other ends of said stationary shaft being fixed to said vacuum envelope and the one end being so positioned as to be deviated from the rotational axis of said rotary structure and said rotary anode target.

2. The rotary anode type X-ray tube according to claim 1, wherein the one end of said stationary shaft on the side of the cathode structure is fixed to said vacuum envelope at a position deviant from the axis of rotation on the side opposite to said cathode structure with respect to the axis of rotation.

3. The rotary anode type X-ray tube according to claim 1, wherein the one end portion of the stationary shaft on the side of the cathode structure is divided into a plurality of branches extending such that the end portions of the branches are fixed to the vacuum envelope at positions deviant from the axis of rotation of the anode target and the rotary structure.

4. The rotary anode type X-ray tube according to claim 1, wherein said stationary shaft has a central bore and an insulating medium is allowed to flow through the central bore of the stationary shaft.

5. The rotary anode type X-ray tube according to claim 1, wherein said bearing is dynamic pressure slide bearing constructed such that spiral grooves are formed on the bearing surface at which said rotary structure and said stationary shaft are allowed to face each other with a small bearing gap interposed therebetween, and a liquid metal lubricant is applied to said bearing gap and said spiral grooves.

6. An X-ray tube apparatus comprising:

an rotary anode type X-ray tube;

a housing vessel for housing said X-ray tube in which an insulating medium is filled;

said rotary anode type X-ray tube including:

a cathode structure for emitting an electron beam a rotary anode target, having a rotational axis and faced to said cathode structure, for radiating an X-ray upon impinging of the electron beam;

a rotary structure having the rotational axis and fixed to said rotary anode target;

a stationary shaft for rotatably supporting the rotary structure, which is fitted in said rotary structure and said anode target, is so arranged as to penetrate the anode target and has one end at the side of said cathode structure and other end at the opposite side of said cathode structure;

a bearing, arranged between said rotary structure and stationary shaft, for allowing said rotary structure to rotate around said stationary shaft; and a vacuum envelope for housing said cathode structure, said rotary anode target, said stationary shaft and said rotary structure, which has a X-ray window for transmitting an X-ray, the one and other ends being fixed to said vacuum envelope and the one end being so positioned as to be deviated from the rotational axis of said rotary structure and said rotary anode target.

7. The X-ray tube apparatus according to claim 6, wherein said stationary shaft has a central bore and the insulating medium is allowed to flow through the central bore of the stationary shaft.

8. The X-ray tube apparatus according to claim 7, wherein the central bore of the stationary shaft is communicated with a circulating hole made in the wall of the housing vessel directly or with a pipe interposed therebetween.

* * * * *